US006125602A

United States Patent [19]

Freiborg et al.

[11] Patent Number: 6,125,602

[45] Date of Patent: Oct. 3, 2000

[54] ASPHALT COMPOSITION RIDGE COVERS WITH THREE DIMENSIONAL EFFECT

[75] Inventors: Mark Freiborg, Huntington Beach; Ben Freiborg, Flintridge, both of Calif.

[73] Assignee: The Dorothy and Ben Freiborg 1980 Trust, Flintridge, Calif.; by said Ben Freiborg

[21] Appl. No.: 09/081,846

[22] Filed: May 20, 1998

Related U.S. Application Data

[63] Continuation-in-part of application No. 08/968,503, Nov. 12, 1997, abandoned, which is a continuation-in-part of application No. 08/795,370, Feb. 4, 1997, abandoned.

[51] Int. Cl.[7] ..... E04D 3/40

[52] U.S. Cl. ..... 52/560; 52/57; 52/198; 52/518; 52/553; 52/631; 52/DIG. 9; 52/DIG. 16

[58] Field of Search ..... 52/57, 198, 199, 52/518, 553, 554, 558, 560, 631, DIG. 9, DIG. 16; 403/205, 364, 403

[56] References Cited

U.S. PATENT DOCUMENTS

| | | |
|---|---|---|
| 1,541,130 | 6/1925 | Finley . |
| 1,756,989 | 5/1930 | Overbury . |
| 1,767,374 | 6/1930 | Kirschbraun . |
| 1,807,918 | 6/1931 | Kirschbraun et al. . |
| 1,924,650 | 8/1933 | Payne . |
| 2,137,308 | 11/1938 | Rahr . |
| 2,150,004 | 3/1939 | MacDonald . |
| 2,168,217 | 8/1939 | Kirschbraun . |
| 2,168,218 | 8/1939 | Kirschbraun . |
| 2,205,307 | 6/1940 | Parsons . |
| 2,347,250 | 4/1944 | Burnett . |
| 2,559,879 | 7/1951 | Kalin . |
| 3,640,044 | 2/1972 | Watts . |
| 3,811,240 | 5/1974 | Horny . |
| 3,852,934 | 12/1974 | Kirkhuff . |
| 3,913,294 | 10/1975 | Freiborg . |
| 4,024,685 | 5/1977 | Aarons . |
| 4,050,209 | 9/1977 | Barker et al. . |
| 4,065,899 | 1/1978 | Kirkhuff . |
| 4,102,107 | 7/1978 | Barker et al. . |
| 4,269,693 | 5/1981 | Hastie . |
| 4,322,928 | 4/1982 | Freiborg . |
| 4,391,076 | 7/1983 | Ferguson . |
| 4,402,169 | 9/1983 | Martin et al. . |
| 4,404,783 | 9/1983 | Freiborg . |
| 4,434,589 | 3/1984 | Freiborg . |
| 4,439,955 | 4/1984 | Freiborg . |
| 4,580,389 | 4/1986 | Freiborg . |
| 4,672,790 | 6/1987 | Freiborg . |
| 4,706,893 | 11/1987 | Brock . |
| 4,731,970 | 3/1988 | Marshall et al. . |
| 4,768,318 | 9/1988 | Freiborg . |
| 4,788,808 | 12/1988 | Slocum . |
| 4,795,661 | 1/1989 | Bondoc et al. . |
| 4,848,057 | 7/1989 | MacDonald et al. . |
| 4,907,499 | 3/1990 | James . |
| 5,094,042 | 3/1992 | Freiborg . |
| 5,098,025 | 3/1992 | Drouin et al. . |
| 5,174,076 | 12/1992 | Schiedegger et al. ..... 52/199 |
| 5,188,299 | 2/1993 | Hendrickson et al. . |
| 5,201,472 | 4/1993 | Brock . |
| 5,232,530 | 8/1993 | Malmquist et al. . |
| 5,295,339 | 3/1994 | Manner . |
| 5,305,569 | 4/1994 | Malmquist et al. . |
| 5,319,898 | 6/1994 | Freiborg . |
| 5,337,965 | 8/1994 | Chiovitti . |
| 5,377,459 | 1/1995 | Freiborg . |
| 5,488,807 | 2/1996 | Terrenzio et al. . |
| 5,502,940 | 4/1996 | Fifield . |
| 5,813,176 | 9/1998 | Tzeng et al. ..... 52/198 |

*Primary Examiner*—Carl D. Friedman
*Assistant Examiner*—Kevin D. Wilkens
*Attorney, Agent, or Firm*—Blakely, Sokoloff, Taylor & Zafman LLP

[57] ABSTRACT

An asphalt composition ridge cover providing a three dimensional character to a roof. The ridge covers are manufactured and packaged in an approximately 90 degree "V" shape so as to require very little bending during installation. Adhesive holds the angle formed during manufacture. The ridge cover may have a thickening member or members thereunder giving the ridge covers a tapered thickness which, when installed, gives the resulting roof a pronounced three dimensional appearance.

53 Claims, 14 Drawing Sheets

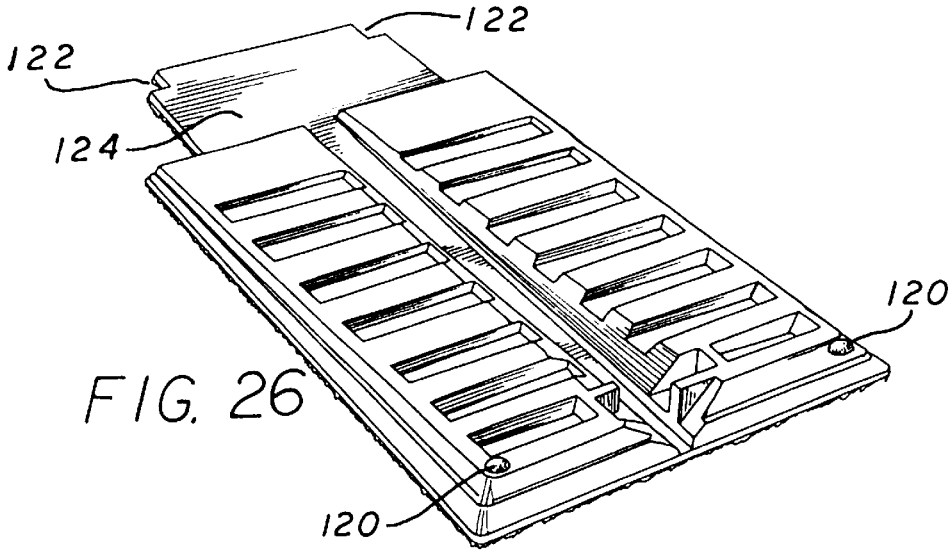
FIG. 26
FIG. 27
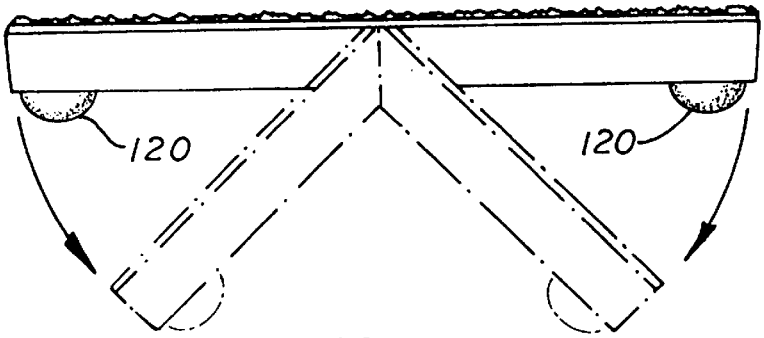
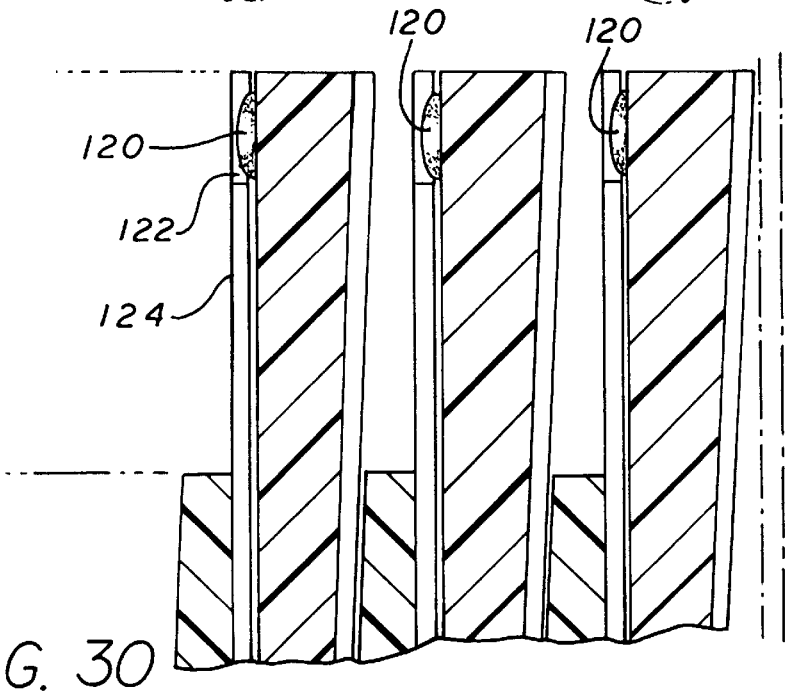
FIG. 30

ASPHALT COMPOSITION RIDGE COVERS WITH THREE DIMENSIONAL EFFECT

This application is a continuation-in-part of application Ser. No. 08/968,503, filed Nov. 12, 1997, entitled "Asphalt Composition Ridge Covers With Three Dimensional Effect", now abandoned, which is a continuation-in-part application of application Ser. No. 08/795,370, filed Feb. 4, 1997, also entitled "Asphalt Composition Ridge Covers With Three Dimensional Effect", now abandoned.

BACKGROUND OF THE INVENTION

1. Field of the Invention

The present invention relates to the field of roofing products, and more particularly to asphalt composition shingles and ridge covers.

2. Prior Art

Asphalt composition roofing of various types is very well known in the prior art. Such material is characterized by a base layer of felt-like material saturated with asphalt and having a layer of asphalt on one surface thereof, binding an outer layer of granules thereto. These materials are relatively inexpensive, lightweight, are fire resistant and of reasonably long life, thereby finding wide usage. Historically however, such roofing has been characterized as providing a relatively flat (i.e., non three-dimensional) appearing roof, thereby having a minimum decorative character.

Efforts have been made to provide an actual or simulated three-dimensional effect in asphalt composition roofing in various ways. For instance, shingles are available having granules of two shades of a color, or two colors, the darker being positioned on the shingle in such an area as to create the visual appearance of a shadow line of a much thicker shingle-like member.

U.S. Pat. No. 3,913,294 discloses a ridge cover which provides a three-dimensional appearance to a roof covered with asphalt composition roofing material by folding the material to provide enhanced thickness in certain areas, giving the roof a substantially enhanced three-dimensional outline or silhouette. A similar effect has been attempted by using multiple layers of asphalt composition material. Also, U.S. Pat. No. 4,322,928 discloses asphalt composition shingles which may be cut from a standard roll of asphalt composition material and then folded to provide regions of differing thickness because of the differing number of thicknesses of the material in the various regions. Another technique of providing the desired appearance is to use varying thicknesses of the asphalt layer over the base material to provide variation in the shingle thickness. Because of the cost of the additional asphalt and other considerations, the extent and area of the additional thickness of the asphalt is typically limited. However, it is still highly desirable to at least use a ridge cover that provides a three dimensional appearance because of the highly desirable pronounced silhouette such a ridge cover gives to the entire roof.

BRIEF SUMMARY OF THE INVENTION

An asphalt composition ridge cover providing a three dimensional character to a roof is disclosed. The ridge cover is characterized as having a thickening member or members thereunder giving the ridge covers a tapered thickness which, when installed, gives the resulting roof a pronounced three dimensional appearance. The thickening member is made from used and scrap asphalt roofing materials which are ground up and heated for forming as desired. Preferably the thickening members are grooved or patterned in a manner to reduce the amount of material therein and to reduce their weight. Grooving on the underside of the thickening members across the entire ridge cover in a direction perpendicular to the length of the ridge cover, together with the separation of the roof boards at the roof peak, will provide attic ventilation. Also preferably the ridge covers are manufactured and packaged in an approximately 90 degree "V" shape so as to require very little bending during installation. Details and alternate embodiments are disclosed.

BRIEF DESCRIPTION OF THE DRAWINGS

FIG. 26 is a perspective view of a single, flat ridge cover in accordance with a still further embodiment of the present invention.

FIG. 27 illustrates the bending of the alternate embodiment ridge cover of FIG. 26 to its final preferred manufactured form.

FIGS. 29 and 30 illustrate the packaging of the ridge covers of FIGS. 26 through 28 so that the adhesive on one ridge cover does not engage the adjacent ridge cover.

DETAILED DESCRIPTION OF THE INVENTION

Figure 1:
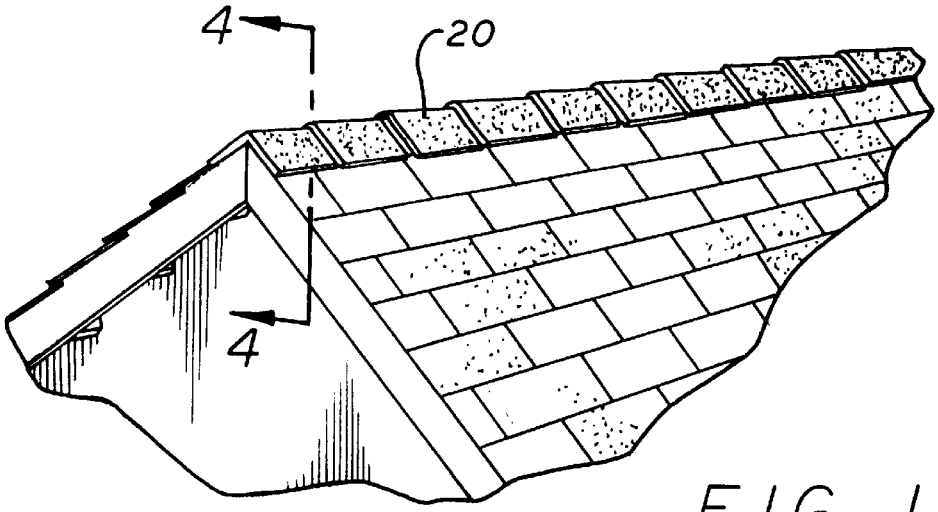
FIG. 1 is a perspective view of a roof illustrating the present invention thereon.

First referring to FIG. 1, a perspective view of a section of a roof of a home covered with the ridge covers of the present invention may be seen. As shown therein, the ridge covers appear much like conventional asphalt composition ridge covers, but with the exposed end thereof being much thicker than conventional ridge covers, tapering down to the step up of the next ridge cover. This provides not only a shadow line, but in effect a true three-dimensional effect, giving the roof a three-dimensional appearance similar to that obtained by wood shake, rather than the generally flat and uninteresting appearance of conventional asphalt composition ridge covers. The net effect is to produce a strong three dimensional silhouette for the roof, giving the entire roof a three dimensional appearance, whether or not the shingles themselves have any special attribute to give them a three dimensional appearance also.

Figure 2:
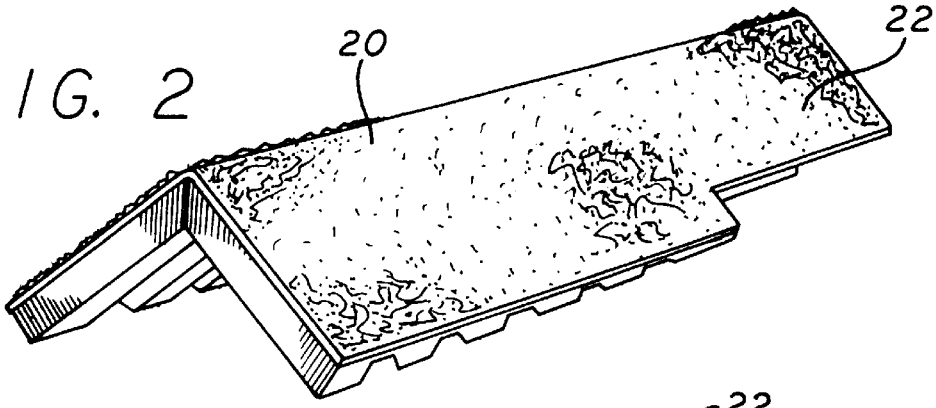
FIG. 2 is a side perspective view and FIG. 3 is a bottom perspective view of an individual ridge cover in accordance with the present invention.
Figure 3:
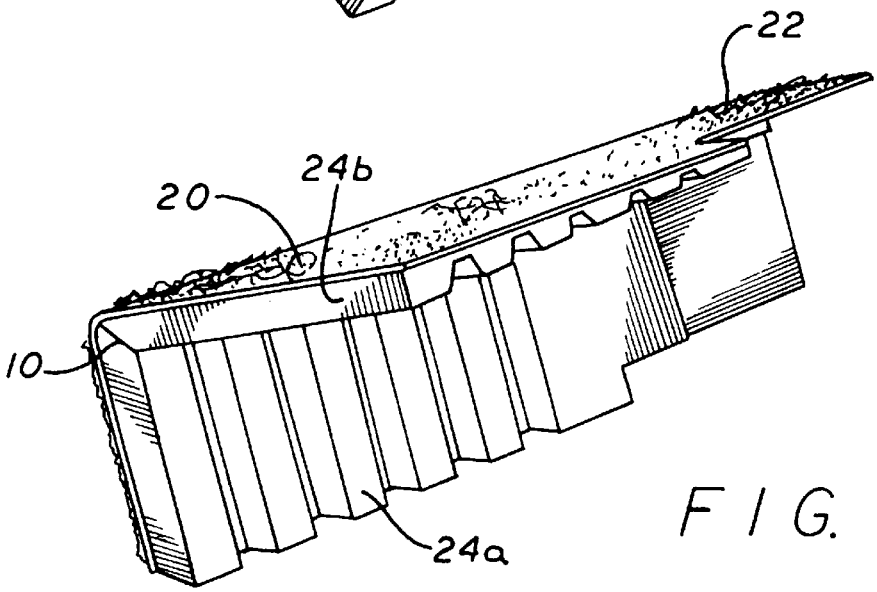

FIG. 2 is a side perspective view and FIG. 3 is a bottom perspective view of an individual ridge cover in accordance with the present invention. In this embodiment, the ridge cover comprises an approximately rectangular sheet of asphalt composition roofing material 20 approximately 12 inches long and 8 inches wide at one end and having a notched region to define a tail section 22 having a width of approximately 6 and ½ inches and a length of approximately 4 inches to provide an eight inch coverage when installed. The ridge cover is provided with thickening members 24*a* and 24*b* bonded to the underside of the asphalt composition roofing material 20. The thickening members have a maximum thickness of approximately 7/16 inches at the larger end of the ridge cover and taper down to a minimum thickness of approximately 1/16 inches approximately 3 and ¼ inches from the smaller end of the ridge cover. The ridge cover is formed at an approximately 90 degree angle at the time of manufacture when the material is warm, with the two thickening members joined at the apex with a flexible adhesive 10 to hold the angle, but to allow variation thereof at the time of installation dependent on the specific pitch of the roof on which the ridge covers are to be installed. The thickening members have approximately 45 degree beveled edges adjacent the centerline of the ridge cover.

In the description herein and as used in the claims, the phrase "approximately rectangular" is used to distinguish from round, oval, triangular or other shapes departing substantially from a rectangular shape, and includes among other shapes, truly rectangular shapes, four sided shapes wherein two opposite sides are parallel and the other two sides are somewhat non parallel so as to define a member having a somewhat tapered width, and a stepped shape as shown in the Figures herein (see FIGS. 2 and 3). Also the asphalt composition roofing material is characterized by a mat or roving of fibrous material typically saturated with asphalt, and having a layer of asphalt bonding inorganic granules to the top surface of the roofing material. The mat may be an organic mat, or an inorganic mat such as a fiberglass mat, and the asphalt may have or include a modifier, locally or throughout, to make the material more flexible, particularly in cold weather, though one of the features of the present invention is the minimization of the bending of the ridge cover required on installation, thereby substantially eliminating the advantage of a flexiblizer. Generally the selection of the mat material, the granule color, etc. will be coordinated with the same parameters for the shingles on the roof for overall physical and visual compatibility.

Figure 4:
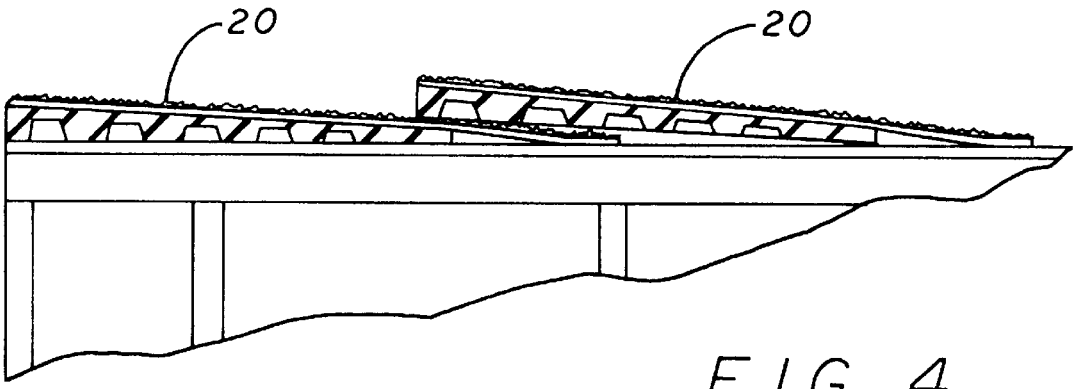
FIG. 4 is a view taken along line 4—4 of FIG. 1.

In the preferred embodiment shown in FIGS. 2, 3 and 4, the underside of the thickening members 24*a* and 24*b* are embossed with a pattern. This has the effect of reducing the amount of material needed for the thickening members, reducing manufacturing costs somewhat. It also reduces the weight of the product, reducing shipping costs and the weight added to an installed roof. By having the embossed pattern cover approximately 50% of the area of the thickening members using a pattern having a depth of a substantial fraction of the thickness of the thickening members, the material in, and thus the weight of the thickening members can be reduced approximately 30%.

Figure 5:
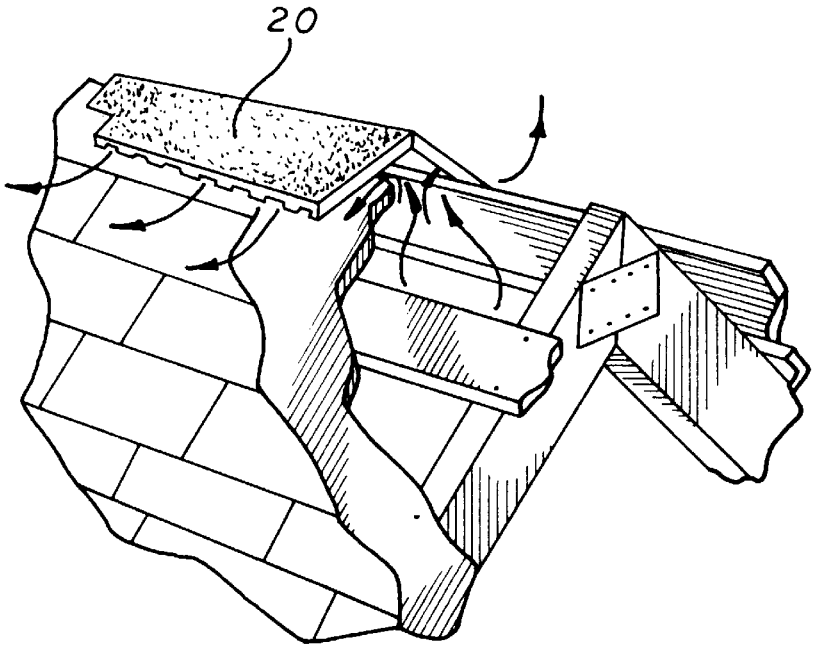
FIG. 5 is a partial cross section of a roof illustrating the use of the preferred embodiment for attic ventilation purposes.

Also, by using grooves (as shown) which on installation will run up and down the roof, the ridge covers of the present invention may provide attic ventilation also, as illustrated in the schematic illustration of FIG. 5. In such a case, the board running along the roof stops short of the peak on each side of the peak, so that air may flow out of the attic through the grooves. This ventilation can significantly cool an attic in the summer, and vent moist air to reduce the chances of wood rot and condensation which may accumulate to stain ceilings. While this general type of ventilation is known in the art, and thus need not be further described herein, it normally requires special ridge cover installation procedures and/or a special ridge cover fabricated at substantial expense just for this use.

Figure 6:
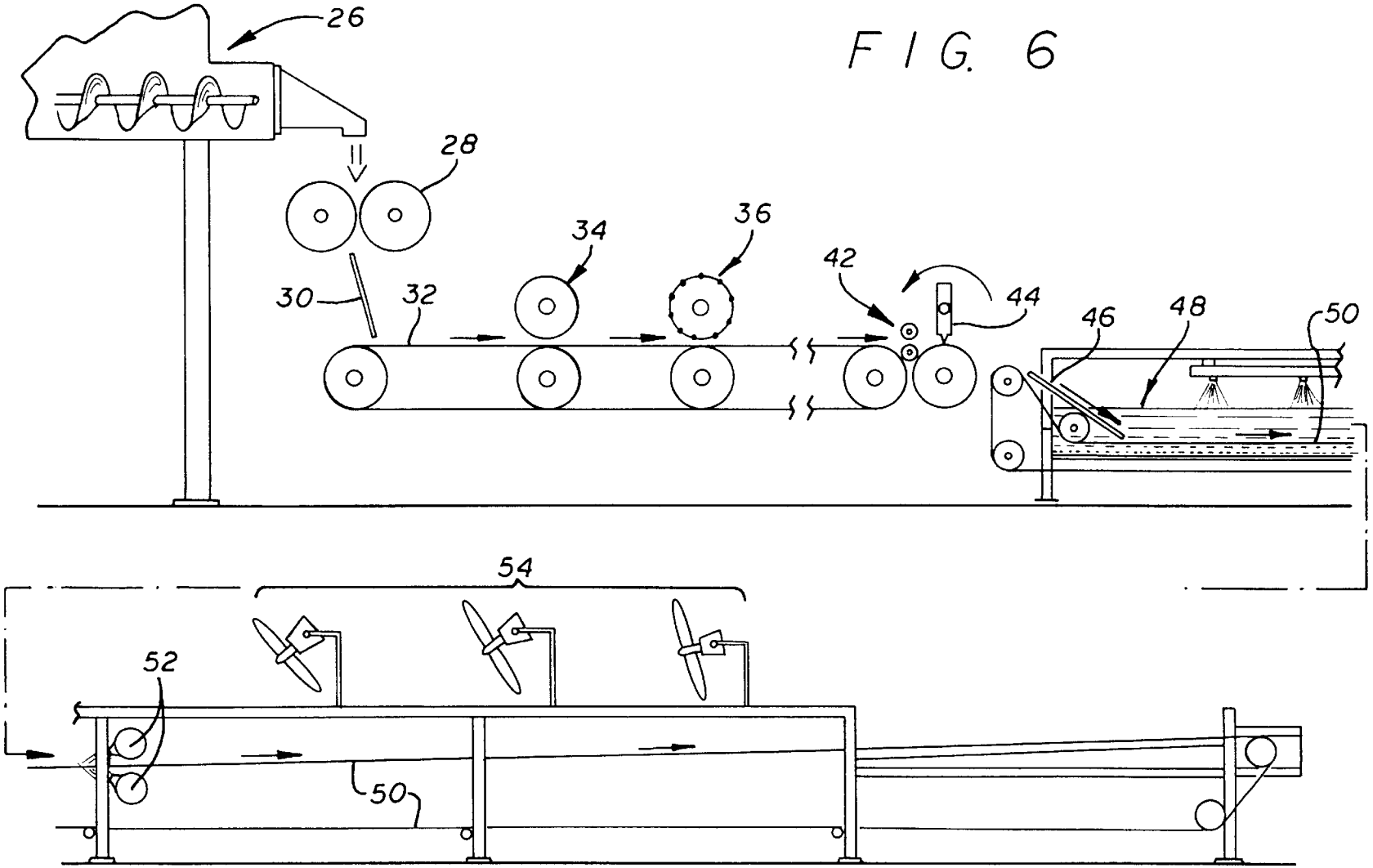
FIG. 6 is a side schematic illustration of the equipment for manufacturing the thickening members used in the preferred embodiment of the present invention.

Now referring to FIG. 6, a side schematic view of the apparatus for forming the thickening members may be seen. These thickening members, further details of which will be subsequently described, in the preferred embodiment are fabricated by grinding up used asphalt composition roofing material and/or new asphalt composition roofing material scrap, using a commercially available grinder, and heating the same to approximately 350° F. to provide an extrudable and formable consistency to the material. Between the grinding and heating step, it is preferable, at least for used roofing material, to pass the same through a magnetic separator so that any nails or nail parts in the ground material may be separated therefrom. Also, if necessary to provide a sufficiently fluid consistency to the heated material adequate for extrusion purposes, additional asphalt may be combined therewith. However, except perhaps for very old and weathered used roofing material, it has been found that a satisfactory consistency is obtained without adding any fresh asphalt thereto.

Figure 7:
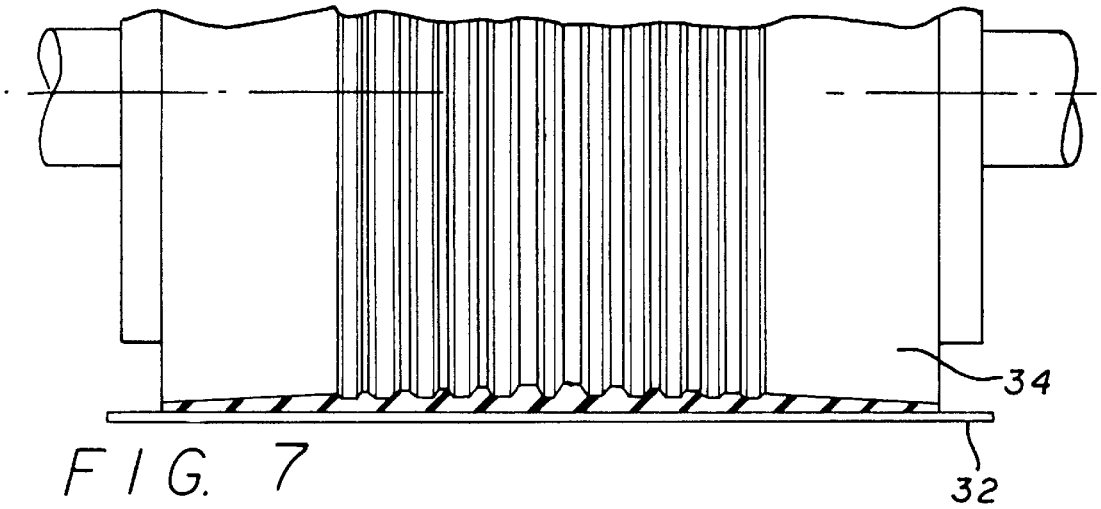
FIG. 7 is a front view of form roller 34 of FIG. 6.
Figure 8:
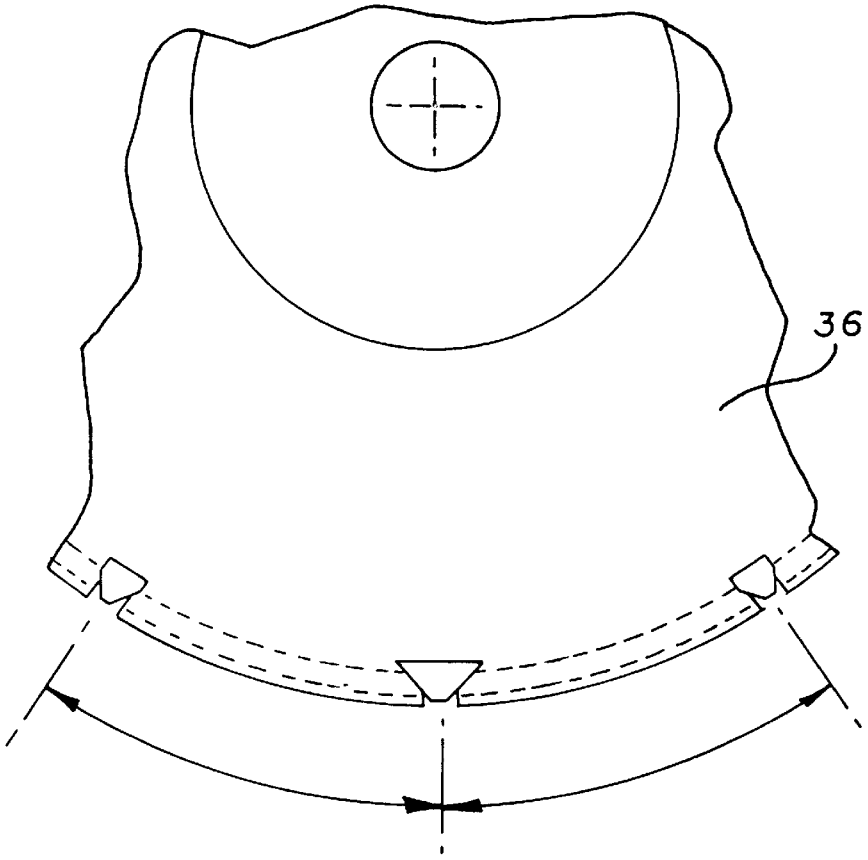
FIG. 8 is a partial end view of form roller 36 of FIG. 6.
Figure 9:
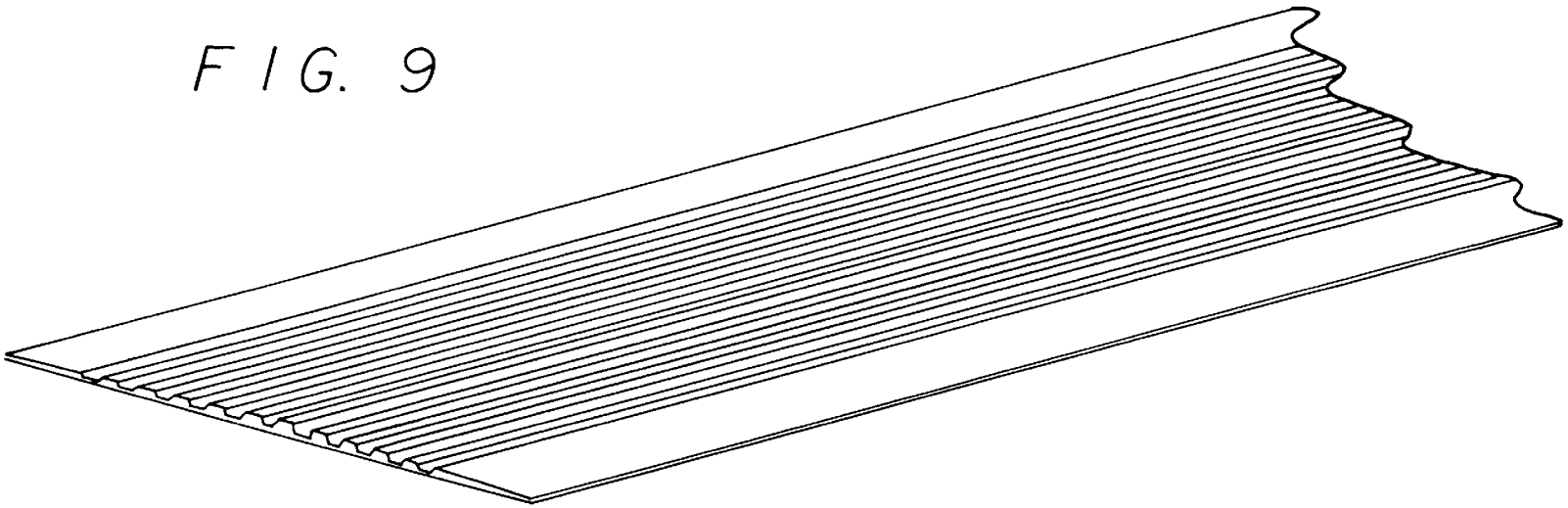
FIG. 9 illustrates the shape of the extruded asphalt material after being formed by forming roller 34.
Figure 10:
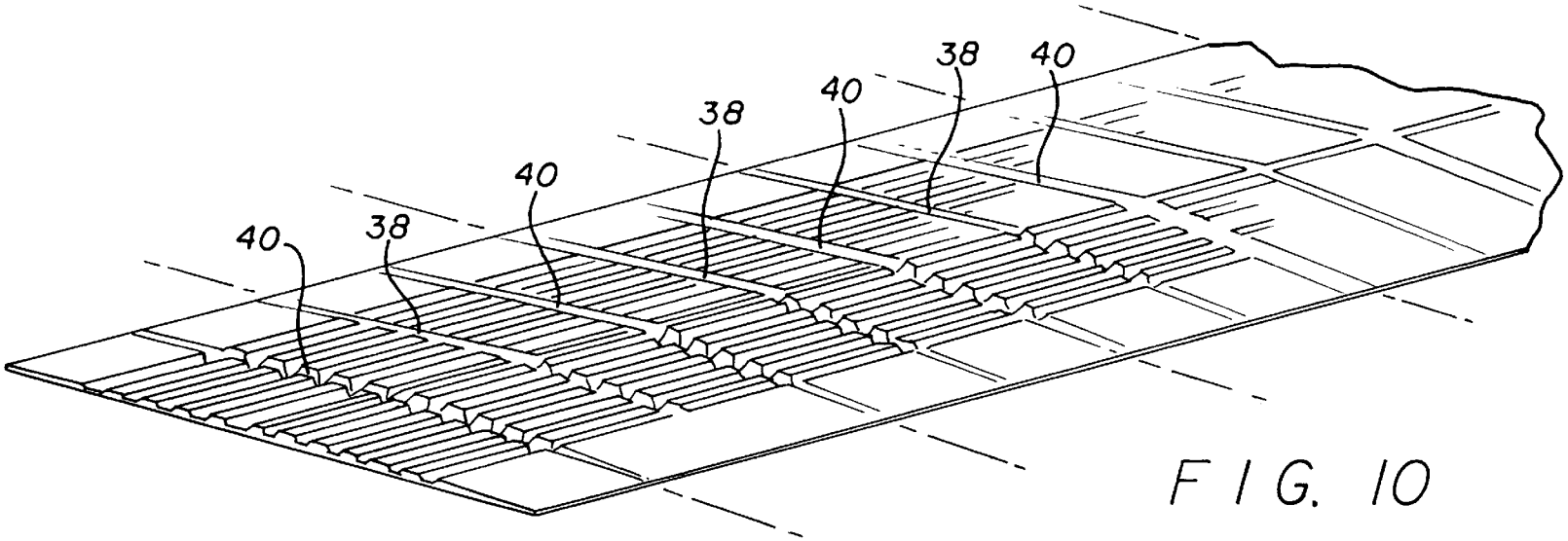
FIG. 10 illustrates the shape of the extruded asphalt material after being formed by forming roller 36.

Once heated, the material is then extruded by extruder 26, passing through initial forming rollers 28, over deflector 30 onto a belt 32. The material is formed by forming roller 34, also shown in FIG. 7, to the continuous shape generally shown in FIG. 9, comprising two rows of thickening members. Then a second forming roller 36, grooved like the roller in FIG. 7 and specifically illustrated in FIG. 8, adds transverse "U" shaped depressions 38 and transverse "V" shaped depressions 40 in the material as may be seen in FIG. 10. As formed, each pair of thickening members are joined at the bottom of a relatively deep 90 degree included angle "V" shaped groove there between, with adjacent pairs of thickening members being joined at the bottom of a relatively deep "U" shaped groove there between. Similarly the two rows of thickening members are joined at the bottom of a relatively deep longitudinally oriented "U" shaped groove there between.

Figure 11:
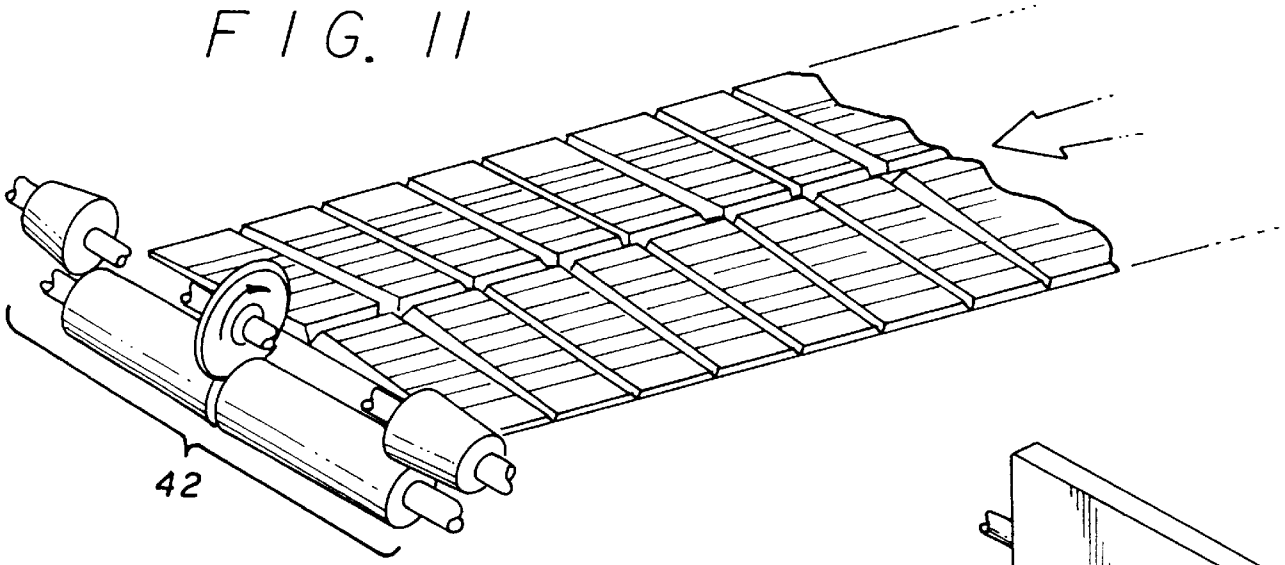
FIG. 11 is a perspective view illustrating the operation of the trim rollers 42 of FIG. 6.
Figure 12:
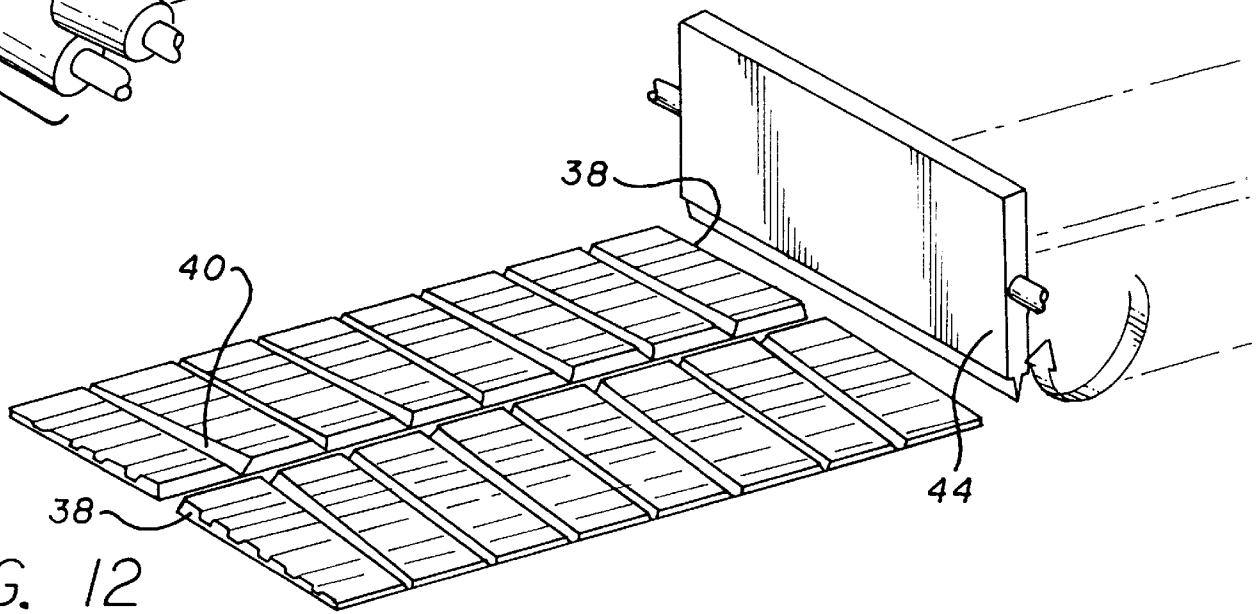
FIG. 12 is a perspective view illustrating the operation of the cutter 44 of FIG. 6.

Then the formed material proceeds past trim rollers 42, also shown in FIG. 11, which trim any excess material from the edges of the formed material and slits the formed material down the center at the bottom of the longitudinal "U" shaped groove, after which the material proceeds to cutter 44. Cutter 44, also shown in FIG. 12, is synchronized with form roller 36 to cut the formed material at the bottom of each fourth "U" shaped groove in the material, thereby cutting the material into 32 inch lengths, each comprising four pair of thickening members.

These 32 inch lengths of material proceed down slide plate 46 into a water bath 48, being carried therethrough by a Teflon mesh conveyer 50. The water bath cools the lengths of formed material to a firm, non-tacky condition. The material proceeds on conveyer 50 in a slight upward direction out of the water bath and between knife-edge blowers 52, which blow dry the cooled material. Fans 54 are also provided for this purpose, in the event conditions require use of the same. The 32 inch lengths of formed material then proceed to the end of the conveyer and are stacked on pallets for use in the subsequent bonding operation.

The use of scrap material and used asphalt composition roofing material removed from existing installations during re-roofing is one of the very advantageous aspects of the present invention. In particular, such material is fully compatible with the asphalt composition material forming the visible side of the final product, and has similar weathering and fire test characteristics. Further, in terms of cost, scrap material and material removed during re-roofing operations is in general very costly to otherwise dispose of, as it must be trucked to a suitable disposal site and dumping charges paid to dispose of it. Consequently, scrap and used material can be substantially free, so long as the manufacturing plant is as accessible to the re-roofing and scrap generating operations as are acceptable dump sites for such materials. However other materials could be used if desired, such as other common construction materials. Also, fillers could be added to the used and scrap asphalt material to enhance fire retardancy, to reduce the material weight and/or to make up for shortages of material, such as pearlite, sand or other preferably noncombustible fillers. However, while used and scrap material are the preferred materials for the thickening members, new asphalt and new filler material such as new ground up mat material may be used if desired or if the supply of used and scrap material is inadequate. Such materials are still relatively inexpensive in comparison to new asphalt composition material, as they represent only the raw materials for asphalt composition roofing.

Figure 13:
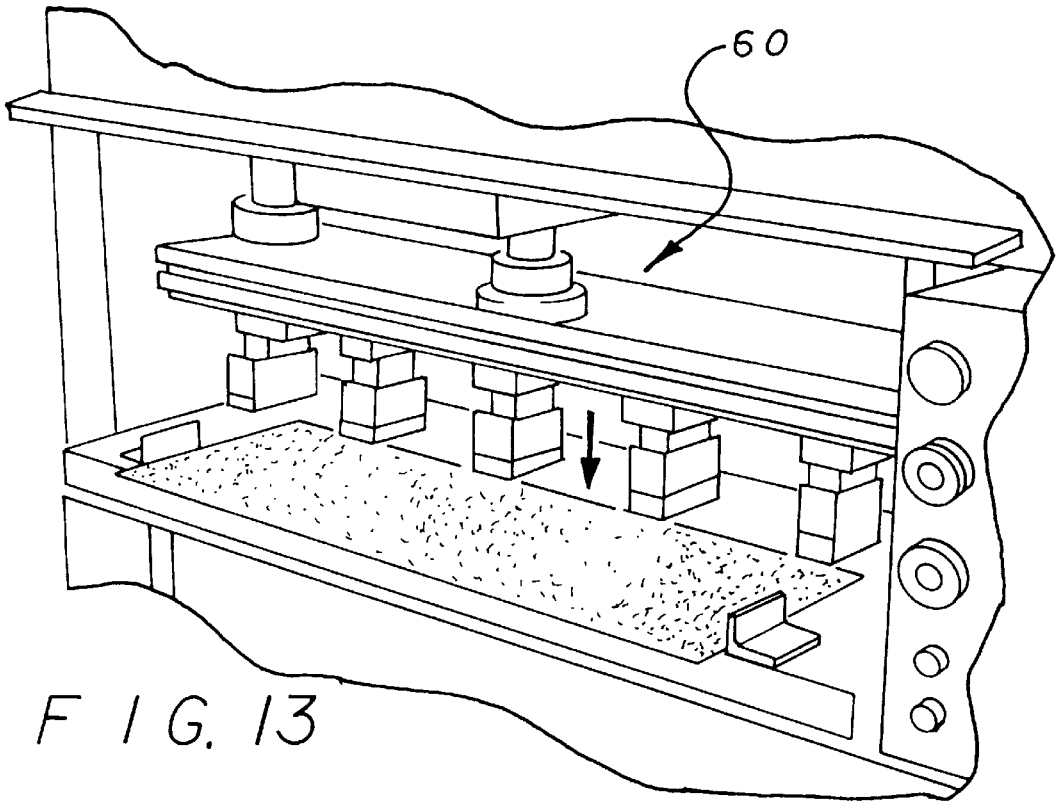
FIG. 13 is a perspective view illustrating the cutting of notches in the ridge cover blanks by die cutter 60.
Figure 14A:
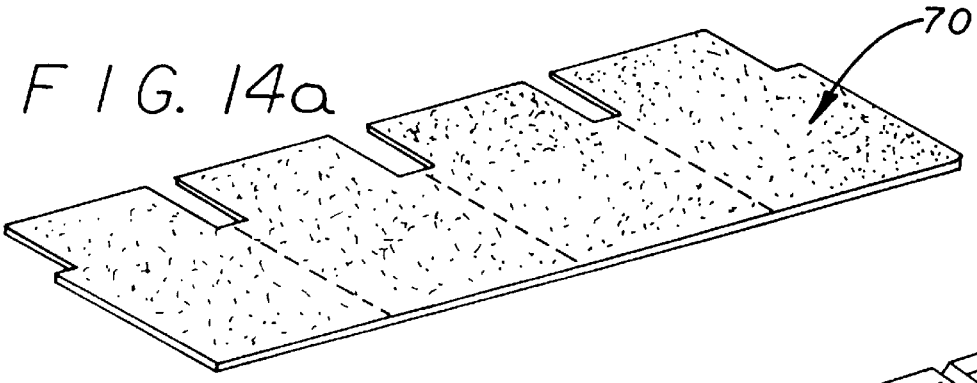
FIG. 14*a* is a perspective view illustrating the notches cut in the ridge cover blanks by die cutter 60.
Figure 14B:
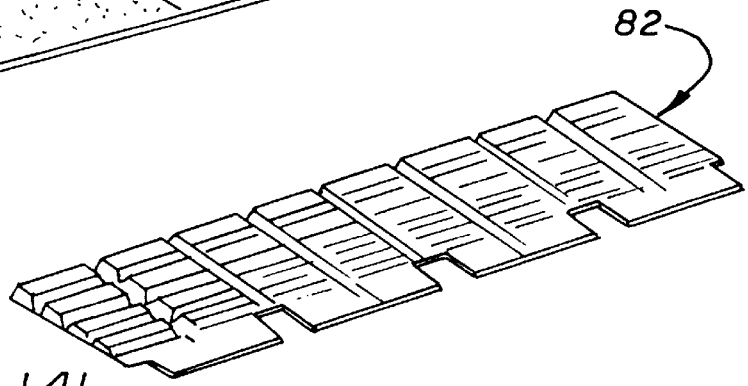
FIG. 14*b* is a perspective view illustrating the notches cut in the thickening members.

In the preferred embodiment, a ridge cover blank is used to provide the outer portion of the ridge cover to which the thickening members are cemented. These ridge cover blanks, for a commercially available prior art ridge cover, comprise a rectangular blank 12 inches wide by 36 inches long and are perforated in three equally spaced regions along the length of the blank to define four individual ridge covers. In the preferred embodiment, the blank is notched as shown in FIG. 13 by a die cutter, generally indicated by the numeral 60, prior to the bonding operation. This die cutter, while shown only notching one ridge cover blank, may notch a substantial plurality of blanks at the same time, if desired. The notched blanks each appear as shown in FIG. 14*a*, and are also stacked awaiting the bonding process. In addition, the thickening members are notched in a complimentary manner, as shown in FIG. 14*b*. This notching may be done, by way of example, with a die cutter much like the notching of the ridge cover blanks, by saws or by a roll cutter added to the thickening member forming equipment of FIG. 6.

Obviously the use of a commercially available ridge cover blank is an arbitrary choice, but may have cost advantages over the manufacture of a special cover blank because of the huge volume in which such ridge covers are currently manufactured. In that regard, such ridge cover blanks of the prior art are intended to be separated into separate individual rectangular ridge covers and nailed in place by the installer. Because of the minimum buildup of thickness of such covers, a purely rectangular shape is acceptable. However because of the thickness buildup of the present invention, enhanced aesthetic characteristics are achieved in the installed ridge by using a substantially rectangular cover somewhat tapered or stepped so that the tail is narrower than the thickened end of the ridge covers.

Figure 15:
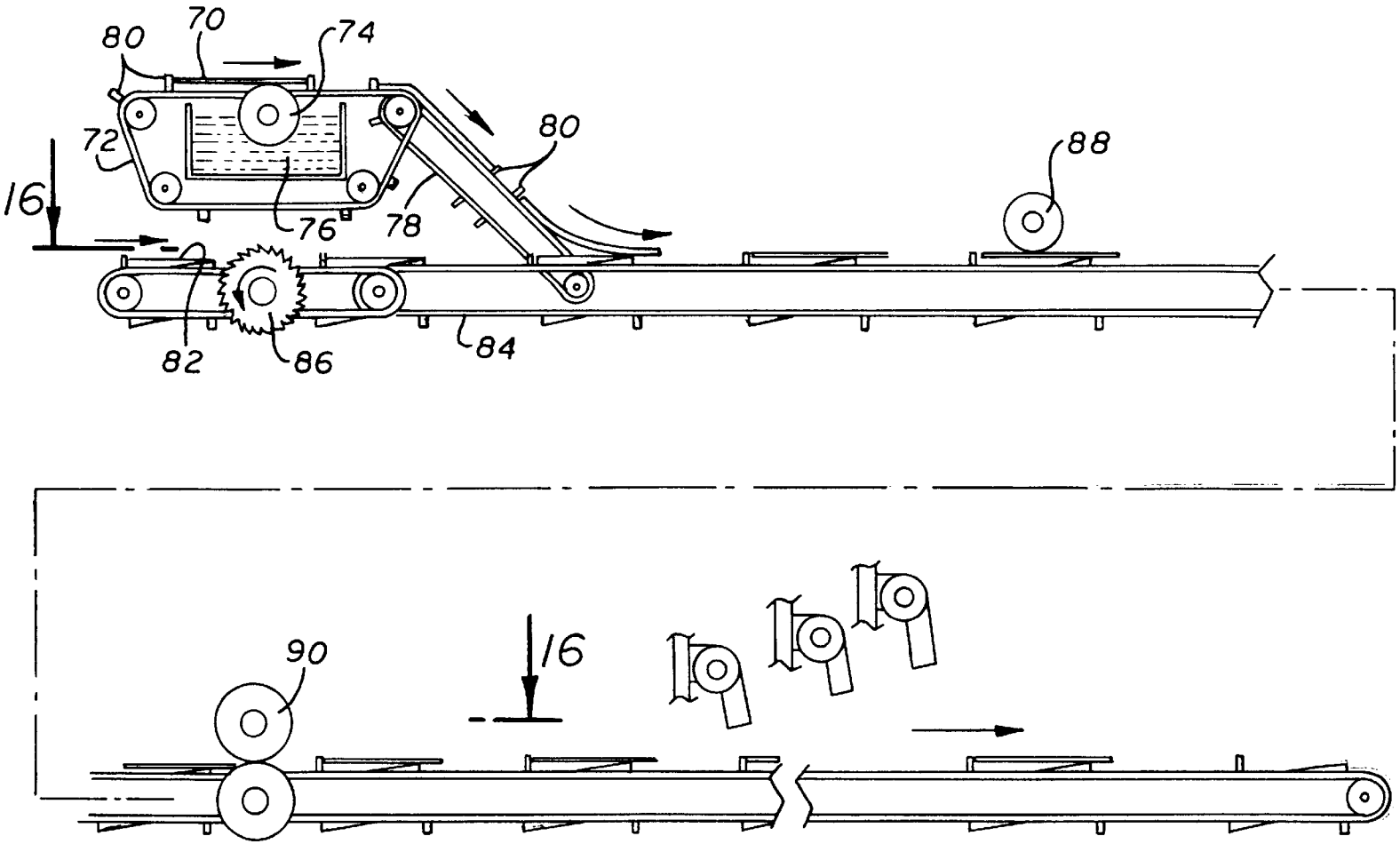
FIG. 15 is a schematic side view of the equipment used to separate the individual thickening members, to bond the same to the ridge cover blanks and to separate the blanks into individual ridge covers.
Figure 16:
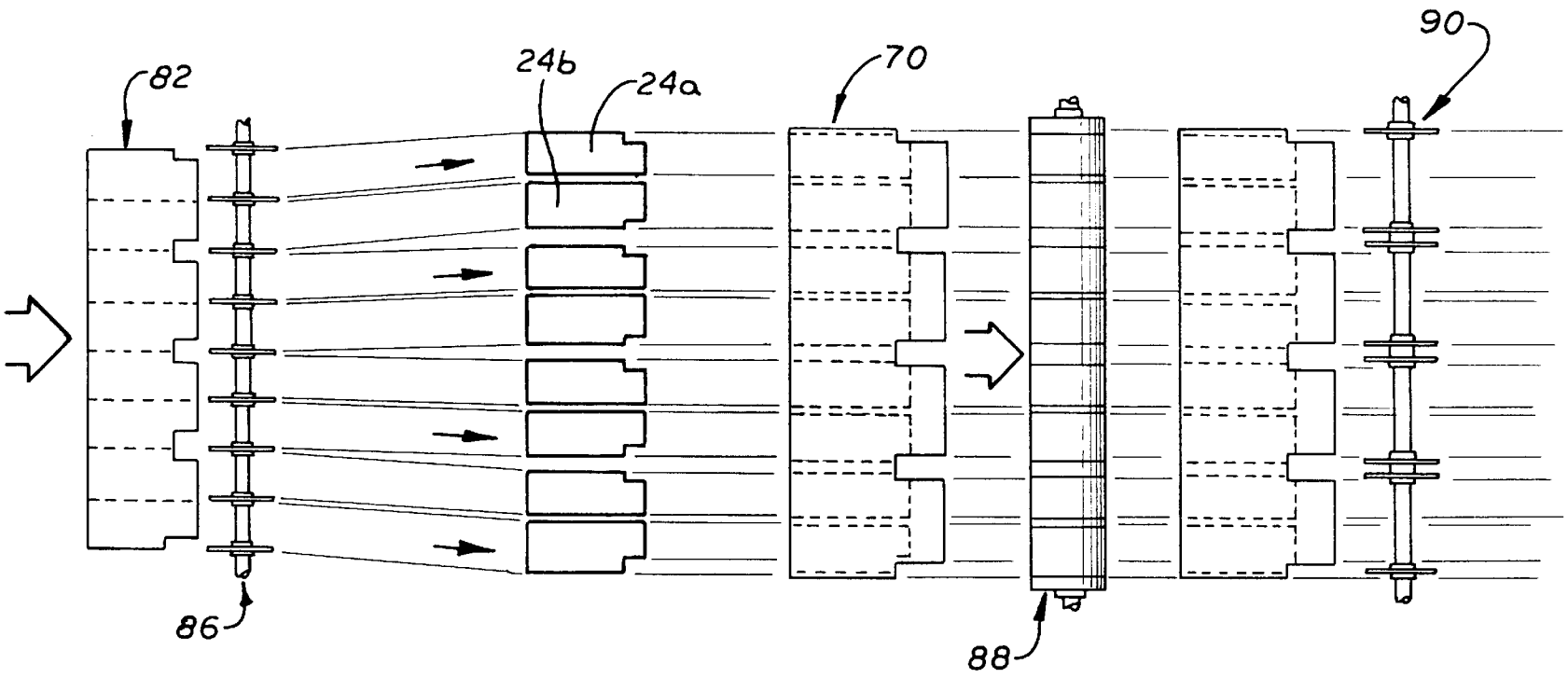
FIG. 16 is a schematic view taken along line 16—16 of FIG. 15.

Now referring to FIGS. 15 and 16, the preferred process for bonding the thickening members to the ridge cover blanks and for separating the same into the individual ridge covers of the present invention may be seen. FIG. 15 is a schematic side view of the equipment for carrying out the process, whereas FIG. 16 is a top view of part of that equipment taken along lines 16—16 of FIG. 15. The ridge cover blanks 70 are placed on conveyor 72 and passed over a plurality of spaced apart rollers 74 within a vat or tank of heated asphalt adhesive 76, thereby rolling stripes of the asphalt adhesive on selected areas of the underside of the ridge cover blank. The ridge cover blank then proceeds down another conveyer 78, synchronized with conveyer 72, and like conveyer 72, having locating members 80 for receiving and locating the ridge cover blank with respect to the conveyers. In that regard, the conveyers are chain conveyers supporting the ridge cover blank at various positions along its 32 inch length, the long dimension of the ridge cover blank being oriented transverse to the conveyer direction. The chain conveyer 72, by way of example, includes chains between rollers 74 so that the ridge cover blanks are well supported in their path of travel to and from the adhesive coating rollers 74 and down chain conveyer 78.

The four pair of integrally joined thickening members previously fabricated, designated by the numeral 82, are placed on a lower conveyer 84, the lower conveyer also having locating members and an appropriately shaped receiving area to hold the upper surface of the thickening members which will be cemented to the ridge cover blank horizontal. The thickening members are driven past saw blades 86 (see also FIG. 16) which separate the four integrally joined thickening member pairs into eight individual pieces, the saw blades 86 also trimming the outer edge of the outer thickening members. The thickening members are then spread by appropriate guides so as to be laterally spaced in accordance with their desired final position relative to the ridge cover blanks 70 (see FIG. 16). In the preferred embodiment, the individual members making up a pair of thickening members 24*a* and 24*b* are separated at the bottom of the "V" groove by 3/16 inches, and the adjacent members of each pair of thickening members are separated by 1 and 1/16 inches. The separation between the individual members making up a pair of thickening members 24*a* and 24*b* is to accommodate the fact that the asphalt composition material forming the exposed surface of the finished ridge cover acts as a hinge as the assembled cover is bent through 90° to its finished manufactured shape, (or when installed if first bent to shape on installation, a non-preferred process) as shown in FIGS. 2 and 3, and that the effective hinge point is above rather than at the base of the "V", causing the thickening members to move closer to each other as the 90° bend is made.

Downstream of the separation of the thickening members, the ridge cover blanks 70 with the asphalt adhesive thereunder are automatically laid on the thickening members, with the assembly then passing under roller 88 to press the thickening member and the ridge cover blanks into firm bonding contact (see both FIGS. 15 and 16). Then the ridge cover blank with thickening members bonded to the underside surface thereof are encouraged past roll cutters 90 which separate the individual ridge covers, trimming the edges of each of the covers in the process. Any scrap material, of course, may be immediately recycled for the manufacture of additional thickening members.

Figure 17:
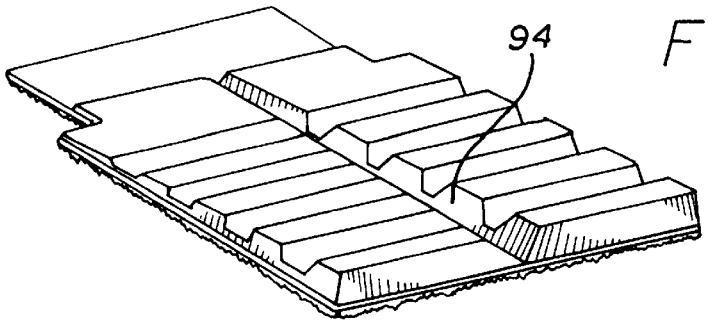
FIG. 17 illustrates a single, flat ridge cover in accordance with the present invention.
Figure 19:
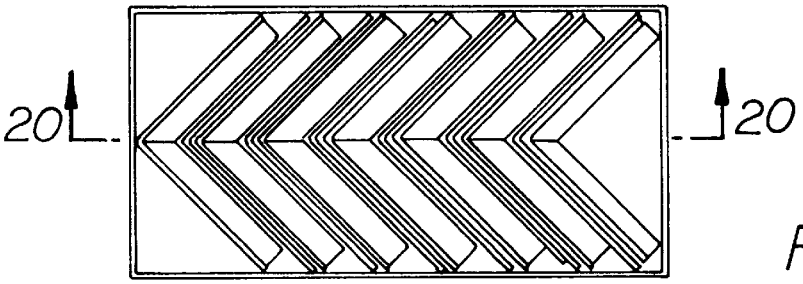
FIG. 19 is a top view illustrating the boxing of the finished ridge covers of the present invention.
Figure 20:
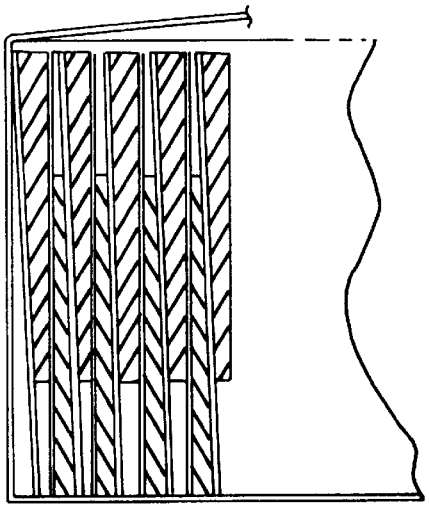
FIG. 20 is a cross sectional view of the boxed ridge covers taken along line 20—20 of FIG. 19.

Next, in the preferred embodiment, a flexible adhesive such as a modified asphalt is applied to "V" groove region 94 and the ridge cover is bent through 90 degrees to form the final product of FIG. 17. The covers are packaged in the preferred embodiment by stacking on end, alternating ends as shown in the top view of FIG. 19 and in the side view of FIG. 20. Packaging in this manner provides a compact package, with the ridge covers providing sufficient structural support to allow reasonable staking of boxed ridge covers without requiring the boxes themselves to provide structural support for stacked boxes of ridge covers as commonly encountered in shipping and storage.

On installation, the ridge covers are put in place and nailed through the tail. While the roof pitch may differ from 45 degrees, the flexible adhesive allows the ridge covers to be bent somewhat on installation to some other angle, even when cold. The prebending of the covers to 90 degrees (or some other angle representative of typical roofs), allows for minimum further bending on installation and thus avoids damaging the asphalt composition material, and particularly the integrity of the granule layer thereon. If desired, a strip of asphalt adhesive may be placed on each ridge cover so that after installation, the heat of the sun will cause the exposed end of one cover to bond to the cover thereunder to prevent any possibility of the end of the ridge cover lifting in high wind conditions. The strip of adhesive may be strategically located so that when the finished ridge covers are boxed as described, the adhesive will line up with a groove in the thickening member of the adjacent ridge cover, thereby preventing the ridge covers from bonding to each other when boxed. However, the rigidity of the "V" shape resulting from the thickening members may in general make the inclusion of such adhesive unnecessary.

Having generally described the preferred embodiment and the preferred method of manufacture thereof, some of the advantages, features and characteristics of the invention may be summarized as follows. The use of post consumer and secondary recycled roofing material to create thickness in the present invention is an important feature of this product. Post consumer and secondary recycled roofing has the necessary qualities that a buildup material needs. It is strong and absorbs very little water. It can be exposed to the outside elements without deteriorating. It holds its form in high climate temperatures and is compatible in color and texture to asphalt roofing. Since post consumer and secondary materials have no cost, this extremely dimensional product can be manufactured and sold at a price that is a real value when compared to other roofing products intended to provide a three dimensional ridge cover.

Figure 21:
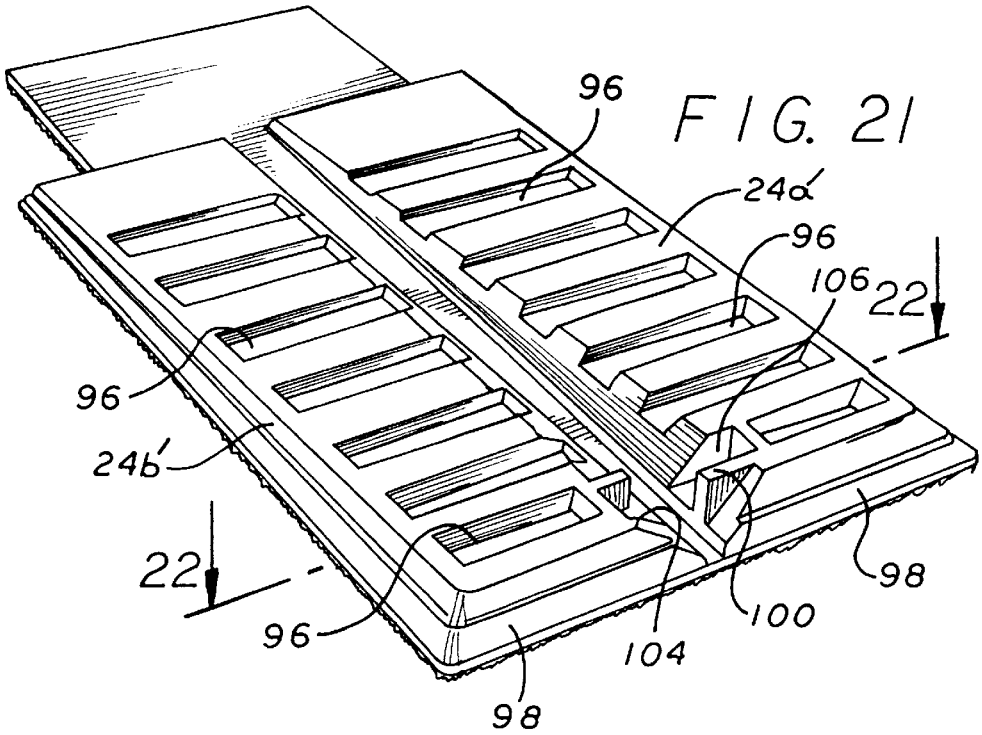
FIG. 21 is a view similar to that of FIG. 17 for an alternate embodiment of the present invention.

Now referring to FIG. 21, a view, similar to that of FIG. 17, of an alternate embodiment may be seen. In this embodiment, thickening members 24*a*' and 24*b*' are embossed with a somewhat different pattern. In particular, the plurality of depressions 96 on the bottom face of the thickening members do not extend all the way to the edges of the thickening members, but rather terminate just short of the edges. While this prevents use of the ridge covers alone for attic venting, it also provides a site barrier, and thus may enhance the appearance of the installed ridge cover, particularly when viewed at relatively short distances.

Also, adjacent the front edges 98 of the thickening members are an interfitting slots and protrusions which cooperatively form both a site barrier and a water barrier when the ridge cover is folded 90° for packaging and when opened somewhat and installed on a ridge having an included angle of greater than 90°. In particular, in the embodiment shown, a protrusion or tab 100 is provided on thickening member 24*a*', and a corresponding tab 102 is provided on thickening member 24*b*'. Opposite tab 100 is a depression or slot 104 and opposite tab 102 is a depression or slot 106. These tabs and depressions are also visible in FIG. 22, which is a bottom plan view of the ridge cover taken along line 2213 22 of FIG. 21.

Figure 22:
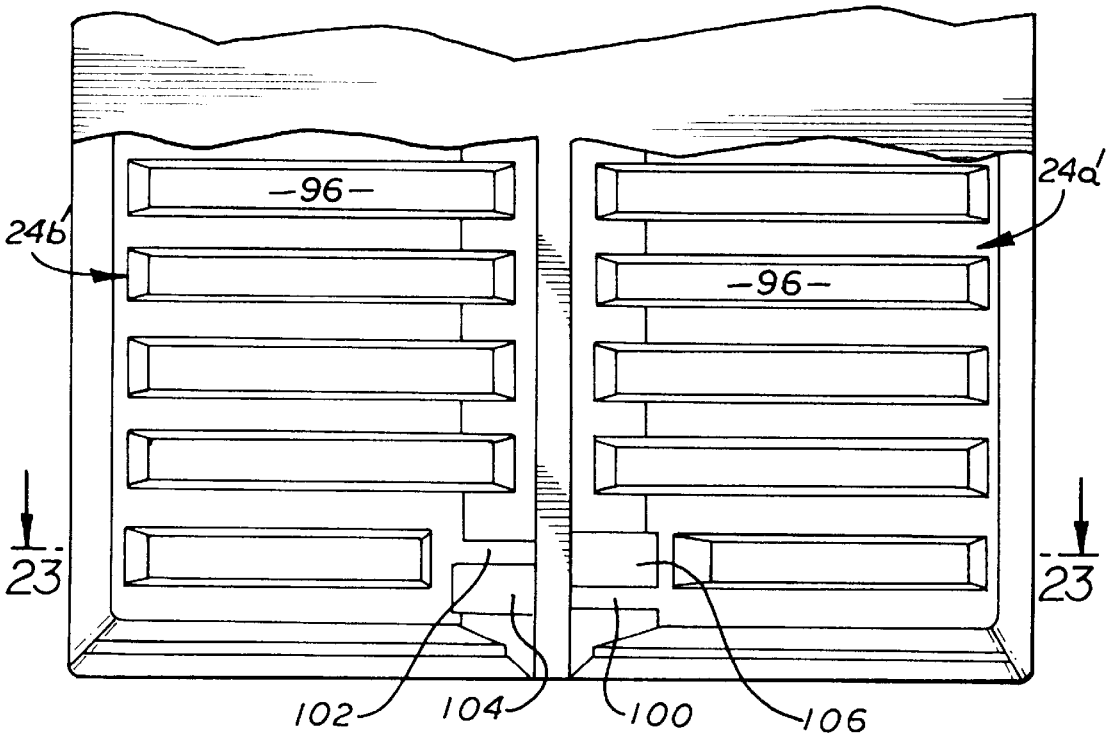
FIG. 22 is a bottom plan view of a portion of the embodiment of FIG. 21 taken along line 22—22 of FIG. 21.
Figure 23:
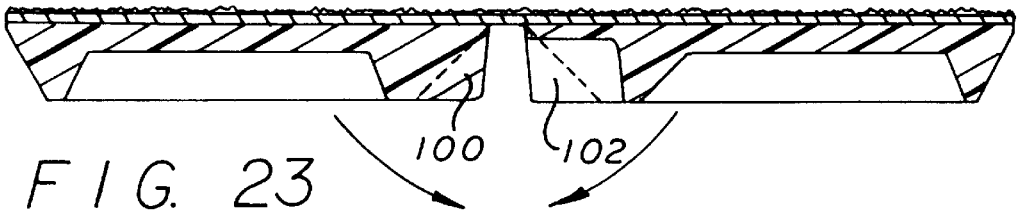
FIG. 23 is a cross section taken along line 23—23 of FIG. 22.
Figure 24:
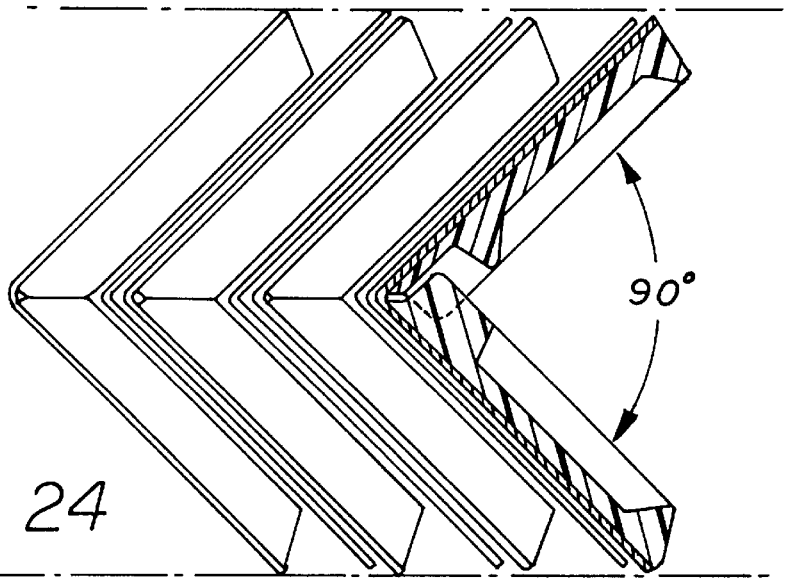
FIG. 24 is a end view, in partial cross section, of a stack of alternate embodiment ridge covers similar to that of FIG. 19.
Figure 25:
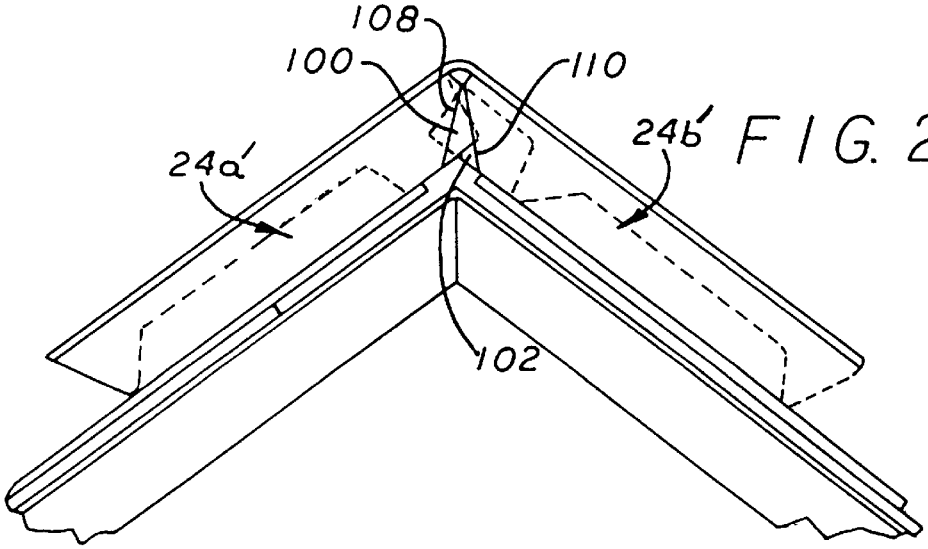
FIG. 25 is an end view of the alternate embodiment ridge cover as opened somewhat for installing on a ridge having an included angle of greater than 90°, illustrating the water and sight barrier provided by the alternate embodiment.

FIG. 23 is a cross-section taken along line 23–23 of FIG. 22, illustrating an end view of the tabs 100 and 102. When the ridge cover is folded to 90° for packaging as illustrated in FIG. 24, a figure similar to that of FIG. 19, it may be seen that the tabs and slots interfit. At the same time, the "V" between the two thickening members (FIG. 21) closes up so that the interfitting tabs and slots have little effect. However when, as in FIG. 25, the ridge cover is installed on a ridge having an included angle of more than 90°, the "V" groove between thickening members 24*a*' and 24*b*' begins to open, the edges of the V groove in FIG. 25 being illustrated by lines 108 and 110. Now the tabs 100 and 102 still interfit into the respective slots in the opposite thickening member, blocking the line of sight along the ridge and under the ridge cover, and further providing a water barrier adjacent the edge of the ridge cover. Thus, the alternate embodiment has the advantage of improved appearance as well as improved moisture barrier characteristics. As a further embodiment, the interfitting tabs and slots may be used in the first embodiment described as well, preserving the attic venting capability if desired.

Figure 28:
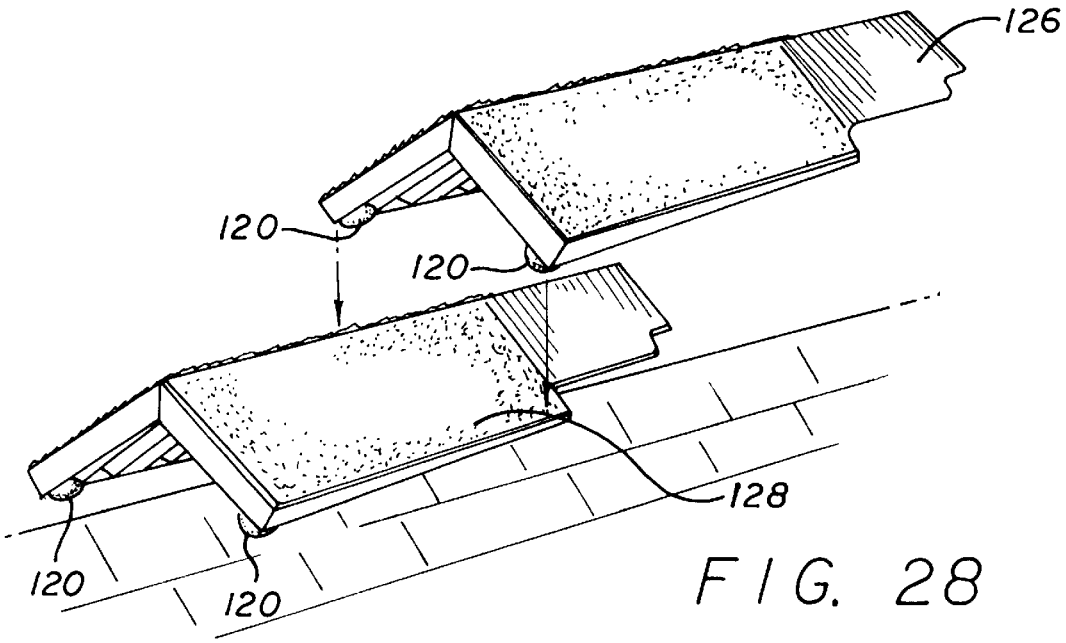
FIG. 28 schematically illustrates the installation of one ridge cover over another so that adhesive regions on one ridge cover will engage the ridge cover thereunder.
Figure 29:
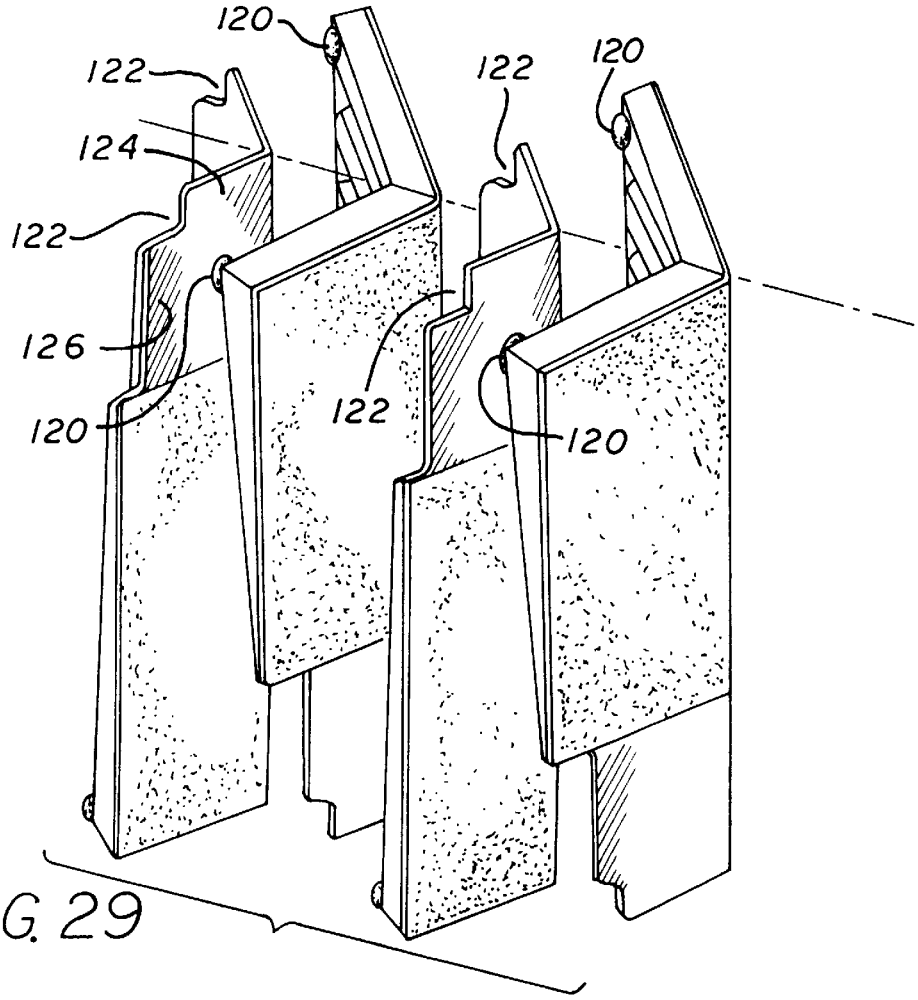

Now referring to FIG. 26, a still further alternate embodiment of the present invention may be seen. In this embodiment, the forward underside corners of the thickening members have blobs of asphalt adhesive 120 placed thereon as part of the manufacturing process. Such asphalt adhesives are well known in the prior art, and will soften in the heat of sunlight on a warm day to cause the member on which the adhesive is placed to essentially become bonded to the member thereunder directly in contact with the adhesive. The embodiment shown in FIG. 26 is also characterized by cut-away corner regions 122 in the tail of the ridge cover, and finally by a thickened tail region 124. The tail region is preferably thickened by applying a further hot asphalt coating on the tail region 124, either on the upper surface 126 (see FIGS. 28 and 29) or alternatively, on both sides of the tail region or on the underside only, though applying the same at least to the upper (granulated) surface of the tail region is preferred. In the preferred embodiment, the tail region of each ridge cover is dipped in a modified asphalt, thickening the tail region and increasing the tear strength thereof to provide increased structure and rigidity to the tail region.

Figure 18:
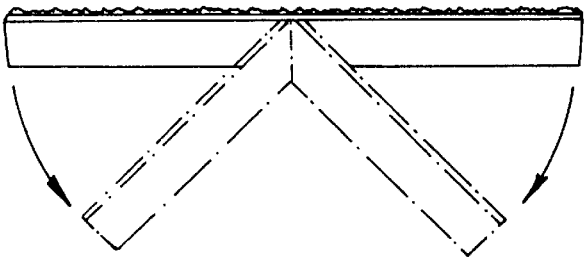
FIG. 18 illustrates the bending of the ridge cover of FIG. 17 to its final preferred manufactured form.

The ridge cover of the embodiment of FIG. 26 is folded through a 90° angle as illustrated in FIG. 27, in the same way as was previously described with respect to FIG. 18, and packaged for shipment in the folded state. In packaging, the ridge covers are stacked one against another, though with each ridge cover being inverted with respect to the two adjacent ridge covers, as was previously described with respect to FIGS. 19 and 20. The stacking of the embodiment of FIG. 26 is illustrated schematically in FIG. 29 and in an exploded view of a portion of the edge of stacked ridge covers in FIG. 30. It may be seen from FIGS. 29 and 30 that the asphalt adhesive blobs 120 align with the notched corner regions 122 in the tail region 124 of an adjacent stacked ridge cover. Further, as illustrated in FIG. 30, the blobs 120 preferably are limited in height to something less than the thickness of the tail region of the ridge cover so that in the stacked condition, the notched tail regions form spacers around the asphalt adhesive blobs to prevent the same from touching the surface of still the next ridge cover in the stack. In this manner, ridge covers with the asphalt adhesive thereon may be stacked for shipment without the use of a waxed release strip of any kind without fear of ridge covers becoming bonded together in the stack because of the asphalt adhesive. The thickening of the tail region 126 has the further advantage of allowing a slightly higher blob and further assuring that the stacked ridge covers will not become bonded together in any way. However, upon normal installation of the ridge covers, illustrated schematically in FIG. 28, the asphalt adhesive blobs 120 will become directly in contact with regions 128 of the ridge cover there below, softening, flattening and spreading in the heat of the sun on a warm day while adhering to the ridge cover below, so that installed ridge covers become bonded, one to another, so as to resist lifting under the most severe of weather conditions. The additional layer of asphalt on the upper surface of the tail regions 126 also provides a better surface for bonding by the adhesive blobs than a granule coated surface might provide.

It should be noted that, by way of example only, other roofing products such as shingles and the like may also gain enhanced three dimensional appearances by the bonding of one or more appropriately configured thickening members to the bottom surface thereof. Accordingly the present invention is not to be limited only to the specific illustrative application disclosed herein, namely ridge covers.

While preferred embodiments of the present invention and exemplary processes of fabrication thereof have been disclosed and described in detail herein, it will be obvious to those skilled in the art that various changes in form and detail may be made therein without departing from the spirit and scope thereof.

What is claimed is:

1. An asphalt composition ridge cover comprising an approximately rectangular sheet of asphalt composition roofing material having top and bottom surfaces, first and second ends, and first and second side edges on each side of a ridge cover centerline, the sheet of asphalt composition material being folded through an angle along the centerline with an adhesive holding the angle.

2. The asphalt composition ridge cover of claim 1 wherein the adhesive is an elastic adhesive that allows the angle to be adjusted at the time of installation.

3. The asphalt composition ridge cover of claim 1 wherein the sheet of asphalt composition roofing material has a distance between the first and second side edges which is greater at the first end than at the second end.

4. The asphalt composition ridge cover of claim 1 wherein the sheet of asphalt composition roofing material has a step change in width adjacent the second end so that the distance between the first and second side edges is greater at the first end than at the second end.

5. The asphalt composition ridge cover of claim 1 wherein the angle is approximately a ninety degree angle.

6. The asphalt composition ridge cover of claim 1 further comprised of blobs of asphalt adhesive, each blob adjacent the first end and a respective side edge of the sheet of asphalt composition roofing material, the second end of the sheet of asphalt composition roofing material having recessed regions adjacent the second end and each of the respective side edges, whereby the blobs of asphalt adhesive will not touch the sheet of asphalt composition roofing material of an adjacent asphalt composition ridge cover when a plurality of ridge covers are stacked with alternate ridge covers rotated end to end.

7. The asphalt composition ridge cover of claim 1 further comprising an additional asphalt coating on the approximately rectangular sheet of asphalt composition roofing material at and adjacent the second end of the ridge cover.

8. The asphalt composition ridge cover of claim 1 wherein the additional asphalt coating at and adjacent the second end of the ridge cover is a dip coating of modified asphalt.

9. The asphalt composition ridge cover of claim 1 further comprising thickening members bonded to the bottom surface thereof on each side of the ridge cover centerline, the thickening members having a maximum thickness adjacent the first end and a minimum thickness adjacent the second end.

10. The asphalt composition ridge cover of claim 9 wherein the thickening members extend from approximately the first end to a position short of the second end.

11. The asphalt composition ridge cover of claim 9 wherein the thickening members are tapered from a maximum thickness adjacent the first end to a minimum thickness adjacent the second end.

12. The asphalt composition ridge cover of claim 9 wherein the thickening members include interfitting protrusions and reliefs adjacent the centerline.

13. The asphalt composition ridge cover of claim 9 wherein the thickening members have an approximately 45 degree beveled edge adjacent the centerline.

14. The asphalt composition ridge cover of claim 13 wherein the beveled edges of the thickening members are cemented together with the adhesive to hold the angle.

15. The asphalt composition ridge cover of claim 9 wherein the thickening members are embossed, reducing the material therein.

16. The asphalt composition ridge cover of claim 15 wherein the thickening members are embossed on the bottom surface thereof, the embossing running from adjacent each side edge of the sheet of asphalt composition roofing material to adjacent the centerline thereof, providing air flow passages there through.

17. The asphalt composition ridge cover of claim 15 wherein the thickening members are embossed on the bottom surface thereof, the embossing running from adjacent the centerline of the sheet of asphalt composition roofing material to adjacent but short of the side edge of the respective thickening member.

18. An asphalt composition ridge cover comprising:

an approximately rectangular sheet of asphalt composition roofing material having top and bottom surfaces, first and second ends, and first and second side edges on each side of a ridge cover centerline, the sheet of asphalt composition material being folded through approximately a ninety degree angle along the centerline, the sheet of asphalt composition roofing material having a layer of granules bonded to the top surface thereof, and thickening members bonded to the bottom surface thereof on each side of the ridge cover centerline, the thickening members having a maximum thickness adjacent the first end and a minimum thickness adjacent the second end, the thickening members having approximately 45 degree beveled edges adjacent the centerline cemented together with an elastic adhesive.

19. The asphalt composition ridge cover of claim 18 wherein the thickening members include reclaimed asphalt composition roofing material.

20. The asphalt composition ridge cover of claim 18 wherein the thickening members include reclaimed new scrap asphalt composition roofing material.

21. The asphalt composition ridge cover of claim 18 wherein the thickening members extend from approximately the first end to a position short of the second end.

22. The asphalt composition ridge cover of claim 18 wherein the sheet of asphalt composition roofing material has a distance between the first and second side edges which is greater at the first end than at the second end.

23. The asphalt composition ridge cover of claim 18 wherein the sheet of asphalt composition roofing material has a step change in width adjacent the second end so that the distance between the first and second side edges is greater at the first end than at the second end.

24. The asphalt composition ridge cover of claim 18 wherein the thickening members are tapered from a maximum thickness adjacent the first end to a minimum thickness adjacent the second end.

25. The asphalt composition ridge cover of claim 18 wherein the thickening members include interfitting protrusions and reliefs adjacent the centerline.

26. The asphalt composition ridge cover of claim 18 further comprised of blobs of asphalt adhesive on the exposed surface of each thickening member, each adjacent the first end and a respective side edge of the sheet of asphalt composition roofing material, the second end of the sheet of asphalt composition roofing material having recessed regions adjacent the second end and each of the respective side edges, whereby the blobs of asphalt adhesive will not touch the sheet of asphalt composition roofing material of an adjacent asphalt composition ridge cover when a plurality of ridge covers are stacked with alternate ridge covers rotated end to end.

27. The asphalt composition ridge cover of claim 18 further comprising an additional asphalt coating on the approximately rectangular sheet of asphalt composition roofing material at and adjacent the second end of the ridge cover.

28. The asphalt composition ridge cover of claim 27 wherein the additional asphalt coating at and adjacent the second end of the ridge cover is a dip coating of modified asphalt.

29. The asphalt composition ridge cover of claim 1 wherein the thickening members are embossed, reducing the material therein.

30. The asphalt composition ridge cover of claim 29 wherein the thickening members are embossed on the bottom surface thereof, the embossing running from adjacent each side edge of the sheet of asphalt composition roofing material to adjacent the centerline thereof, providing air flow passages there through.

31. The asphalt composition ridge cover of claim 29 wherein the thickening members are embossed on the bottom surface thereof, the embossing running from adjacent the centerline of the sheet of asphalt composition roofing material to adjacent but short of the side edge of the respective thickening member.

32. Asphalt composition ridge covers comprising:

a plurality of ridge covers each having;

an approximately rectangular sheet of asphalt composition roofing material having top and bottom surfaces, first and second ends, and first and second side edges on each side of a ridge cover centerline, the sheet of asphalt composition roofing material having a layer of granules bonded to the top surface thereof, and thickening members bonded to the bottom surface thereof on each side of the ridge cover centerline, the thickening members having a maximum thickness adjacent the first end and a minimum thickness adjacent the second end, the sheet of asphalt composition material being folded through approximately a ninety degree angle along the centerline, the thickening members have an approximately 45 degree beveled edge adjacent the centerline, the beveled edges of the thickening members are cemented together with an elastic adhesive;

the ridge covers being stacked on alternate ends for storage and shipping.

33. The asphalt composition ridge covers of claim 32 further comprised of blobs of asphalt adhesive on the exposed surface of each thickening member, each adjacent the first end and a respective side edge of the sheet of asphalt composition roofing material, the second end of the sheet of asphalt composition roofing material having recessed regions adjacent the second end and each of the respective side edges, whereby the blobs of asphalt adhesive will not touch the sheet of asphalt composition roofing material of an adjacent asphalt composition ridge cover when the ridge covers are stacked.

34. The asphalt composition ridge covers of claim 32 wherein the thickening members include interfitting protrusions and reliefs adjacent the centerline.

35. The asphalt composition ridge covers of claim 32 wherein the thickening members are embossed on the bottom surface thereof, the embossing running from adjacent the centerline of the sheet of asphalt composition roofing material to adjacent but short of the side edge of the respective thickening member.

36. The asphalt composition ridge covers of claim 32 wherein the thickening members extend from approximately the first end to a position short of the second end.

37. The asphalt composition ridge covers of claim 32 wherein the sheet of asphalt composition roofing material has a distance between the first and second side edges which is greater at the first end than at the second end.

38. The asphalt composition ridge covers of claim 32 wherein the sheet of asphalt composition roofing material has a step change in width adjacent the second end so that the distance between the first and second side edges is greater at the first end than at the second end.

39. The asphalt composition ridge covers of claim 32 wherein the thickening members are tapered from a maximum thickness adjacent the first end to a minimum thickness.

40. The asphalt composition ridge covers of claim 32 wherein the ridge covers further comprise an additional asphalt coating on the approximately rectangular sheet of asphalt composition roofing material at and adjacent the second end of the ridge covers.

41. The asphalt composition ridge covers of claim 40 wherein the additional asphalt coating at and adjacent the second end of the ridge covers is a dip coating of modified asphalt.

42. The asphalt composition ridge covers of claim 32 wherein the thickening members are embossed, reducing the material therein.

43. The asphalt composition ridge covers of claim 42 wherein the thickening members are embossed on the bottom surface thereof, the embossing running from adjacent each side edge of the sheet of asphalt composition roofing material to adjacent the centerline thereof, providing air flow passages there through.

44. The asphalt composition ridge covers of claim 32 wherein the thickening members include reclaimed asphalt composition roofing material ground, heated and formed to serve as the thickening members.

45. The asphalt composition ridge covers of claim 44 wherein the reclaimed asphalt composition roofing material comprises asphalt composition roofing material previously removed from a roof.

46. The asphalt composition ridge covers of claim 44 wherein the reclaimed asphalt composition roofing material comprises new scrap asphalt composition roofing material.

47. An asphalt composition ridge cover comprising:

a sheet of asphalt composition roofing material having top and bottom surfaces, first and second ends, and first and second side edges on each side of a ridge cover centerline, the sheet of asphalt composition roofing material having a distance between the first and second side edges which is greater at the first end than at the second end, having a layer of granules bonded to the top surface thereof, and having thickening members bonded to the bottom surface thereof on each side of the ridge cover centerline, the thickening members having a maximum thickness adjacent the first end and tapering to a minimum thickness adjacent the second end, the thickening members being embossed, reducing the material therein, the thickening members extending from approximately the first end to a position short of the second end; and blobs of asphalt adhesive on the exposed surface of each thickening member, each blob adjacent the first end and a respective side edge of the sheet of asphalt composition roofing material, the second end of an adjacent identical asphalt composition ridge cover being located between the blobs of asphalt adhesive when a plurality of ridge covers are stacked with alternate ridge covers rotated end to end.

48. The asphalt composition ridge cover of claim 47 wherein the sheet of asphalt composition material is folded through approximately a ninety degree angle along the centerline before being stacked.

49. The asphalt composition ridge cover of claim 47 wherein the thickening members are embossed on the bottom surface thereof, the embossing running from adjacent each side edge of the sheet of asphalt composition roofing material to adjacent the centerline thereof, providing air flow passages there through.

50. The asphalt composition ridge cover of claim 47 wherein the sheet of asphalt composition roofing material has a step change in width adjacent the second end so that the distance between the first and second side edges is greater at the first end than at the second end.

51. The asphalt composition ridge cover of claim 47 wherein the thickening members are embossed on the bottom surface thereof, the embossing running from adjacent the centerline of the sheet of asphalt composition roofing material to adjacent but short of the side edge of the respective thickening member.

52. The asphalt composition ridge cover of claim 47 further comprising an additional asphalt coating on the sheet of asphalt composition roofing material at and adjacent the second end of the ridge cover.

53. The asphalt composition ridge cover of claim 52 wherein the additional asphalt coating at and adjacent the second end of the ridge cover is a dip coating of modified asphalt.

* * * * *